US007621051B2

(12) United States Patent
Ping

(10) Patent No.: US 7,621,051 B2
(45) Date of Patent: Nov. 24, 2009

(54) UTILITY KNIFE

(75) Inventor: Qiu Jian Ping, Hangzhou (CN)

(73) Assignee: Great Neck Saw Manufacturers, Inc., Mineola, NY (US)

( * ) Notice: Subject to any disclaimer, the term of this patent is extended or adjusted under 35 U.S.C. 154(b) by 377 days.

(21) Appl. No.: 11/523,857

(22) Filed: Sep. 20, 2006

(65) Prior Publication Data

US 2007/0011882 A1 Jan. 18, 2007

(51) Int. Cl.
*B26B 1/08* (2006.01)

(52) U.S. Cl. ..... 30/162; 30/335

(58) Field of Classification Search ..... 30/162, 30/335, 2, 143

See application file for complete search history.

(56) References Cited

U.S. PATENT DOCUMENTS

| | | | |
|---|---|---|---|
| 24,502 | A | 6/1859 | Sturdy |
| 158,830 | A | 1/1875 | Buterworth |
| 1,375,029 | A | 4/1921 | Valeggia |
| 2,243,030 | A | 5/1941 | Fischer |
| 2,477,986 | A | 8/1949 | Kennerley |
| 4,242,795 | A | 1/1981 | Rollband et al. |
| 5,207,696 | A | 5/1993 | Matwijcow |
| 6,267,759 | B1 | 7/2001 | Quick |
| 6,484,404 | B1 | 11/2002 | Kao |
| 6,623,499 | B1 | 9/2003 | Andreini et al. |
| 6,796,033 | B2 | 9/2004 | Owoc |
| 2003/0150117 | A1 | 8/2003 | Owoc |
| 2004/0177514 | A1* | 9/2004 | Kaczorowski ..... 30/151 |

FOREIGN PATENT DOCUMENTS

GB 2085790 * 5/1982

* cited by examiner

*Primary Examiner*—Stephen Choi
(74) *Attorney, Agent, or Firm*—Joseph J. Previto

(57) ABSTRACT

A utility knife having a casing, a blade holder moveably mounted within the casing, the blade holder is moveable incrementally from a fully extended position outside the casing to a fully retracted position inside the casing so that the blade holder may be positioned in a partially extended position.

9 Claims, 6 Drawing Sheets

UTILITY KNIFE

BACKGROUND

The present invention relates to a utility knife and more particularly to a utility knife in which the blade may be moved into the handle when the knife is not in use.

Utility knives have been in use for a number of years. Some of these utility knifes have blades which are moveable within a handle when the knife is not in use. However, a number of these utility knives have many movable parts which makes them difficult to use and expensive to manufacture. In some of these utility knives replacement of the blade is a complicated operation which may required the use of special tools. Moreover, some existing utility knives do not have means to permit the blade to be only partially moved out of the handle nor do they have the ability to incrementally move the blade in and out of the handle.

OBJECTS

The present invention overcomes these problems and has for one of its objects the provision of an improved utility knife in which the blade may be easily moved into the handle.

Another object of the present invention is the provision of an improved utility knife in which the blade is held securely on a blade holder.

Another object of the present invention is the provision of an improved utility knife in which the blade moves easily to any position within the handle.

Another object of the present invention is the provision of an improved utility knife in which the blade may be moved incrementally in and out of the handle.

Another object of the present invention is the provision of an improved utility knife which is simple to use and inexpensive to manufacture and maintain.

Other and further objects of the invention will be obvious upon an understanding of the illustrative embodiment described, or will be indicated in the appended claims and various advantages not referred to herein will occur to one skilled in the art upon employment of the invention in practice.

DRAWINGS

A preferred embodiment of the invention has been chosen for purposes of illustration and description and is shown in the accompanying drawings forming a part of the specification, wherein.

DESCRIPTION

Figure 1:
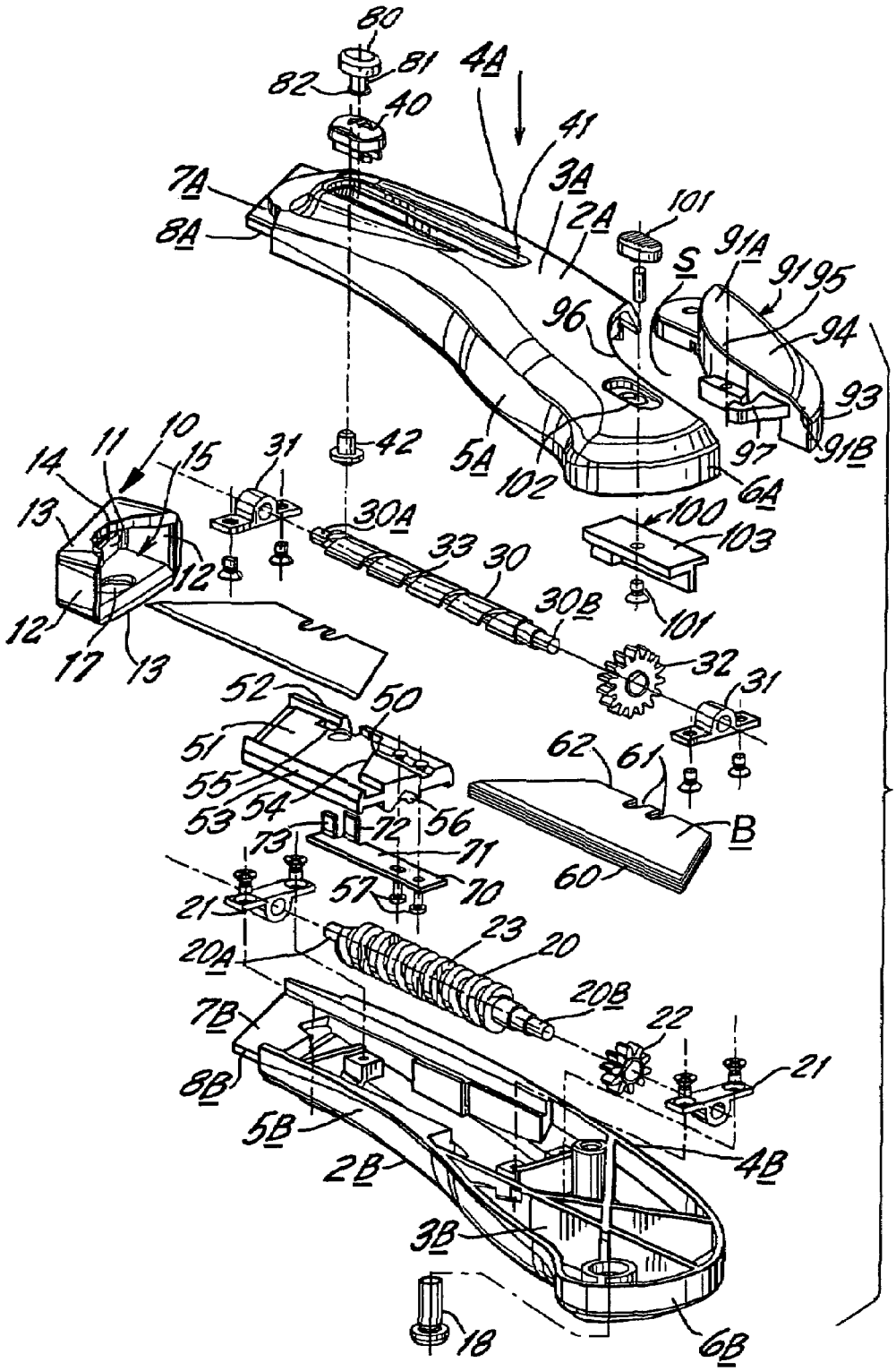
FIG. 1 is an exploded perspective view of a utility knife made in accordance with the present invention.
Figure 2:
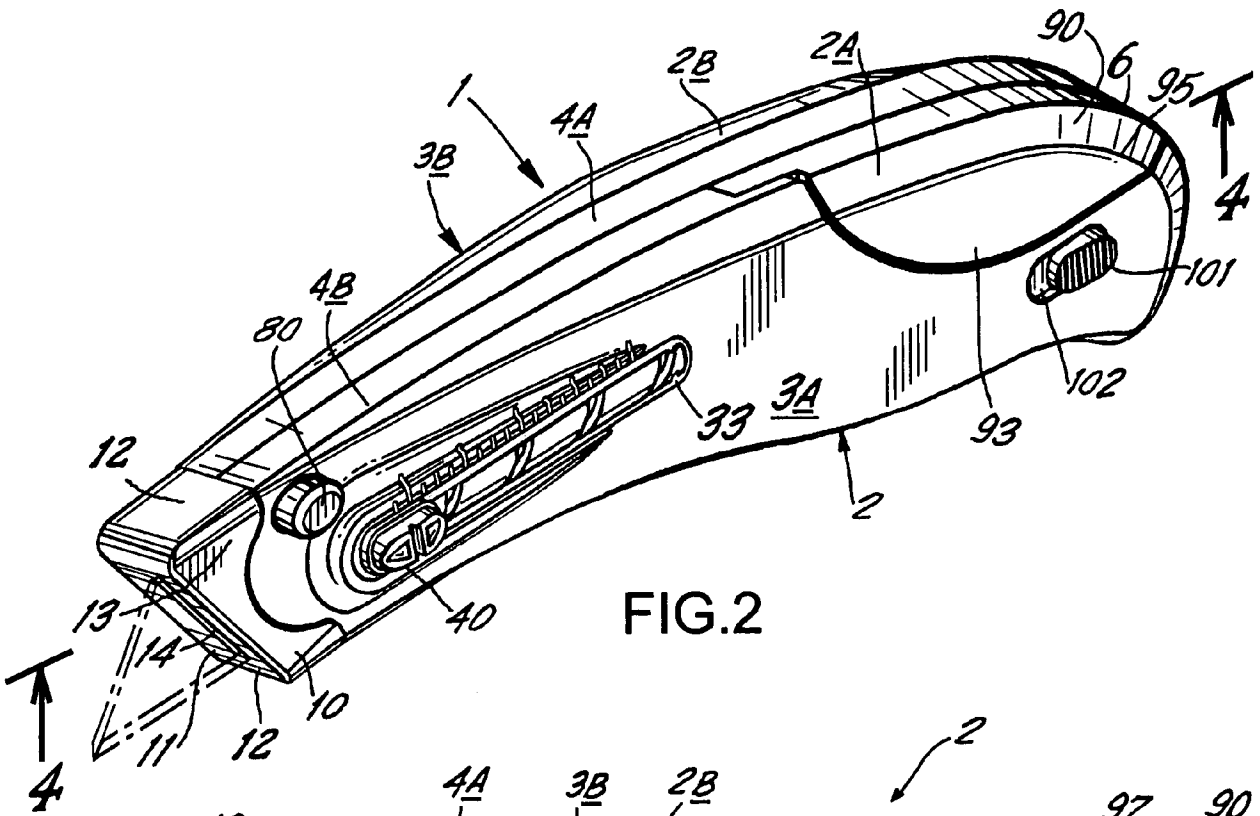
FIG. 2 is a perspective view of the assembled utility knife of the present invention.
Figure 3:
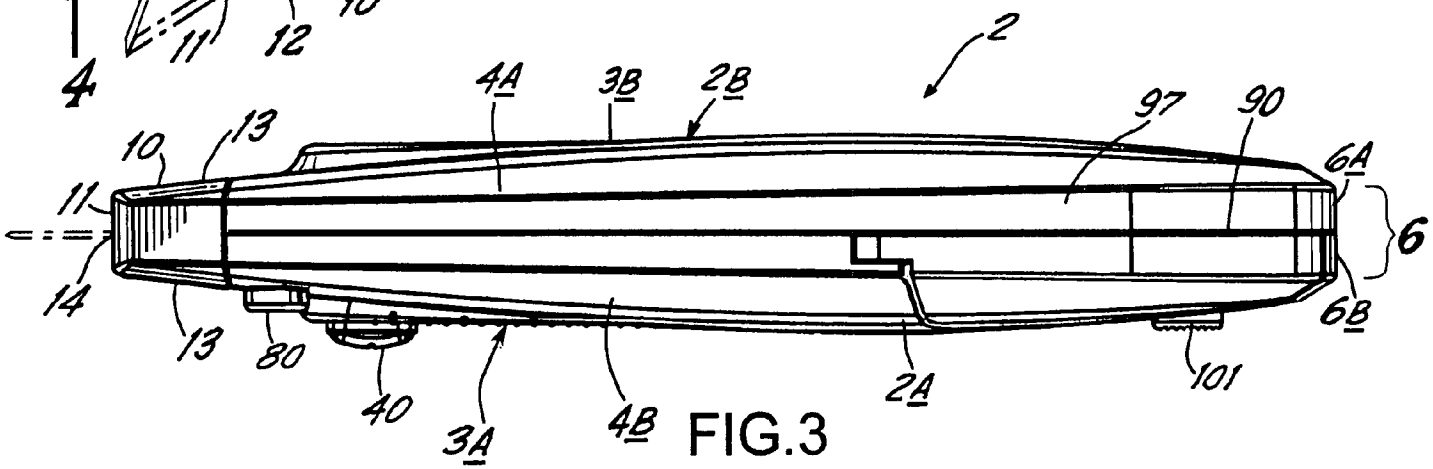
FIG. 3 is a top plan view thereof.
Figure 4:
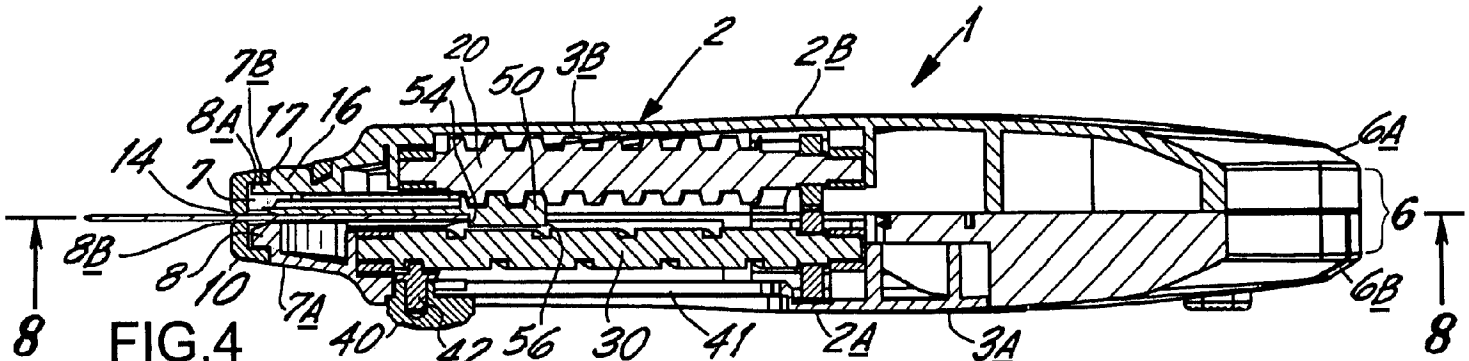
FIG. 4 is a sectional view taken along the line 4-4 of FIG. 2.
Figure 5:
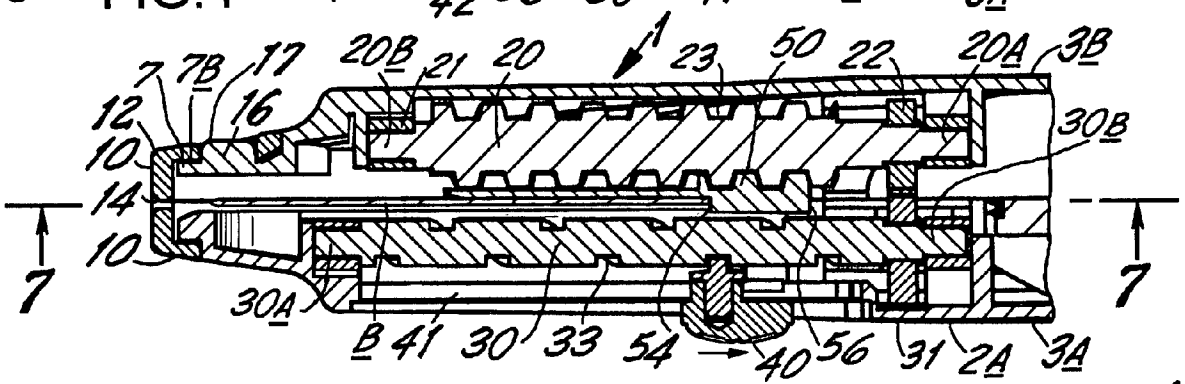
FIG. 5 is an enlarged fragmentary sectional view of the blade moving mechanism of the present invention.
Figure 7:
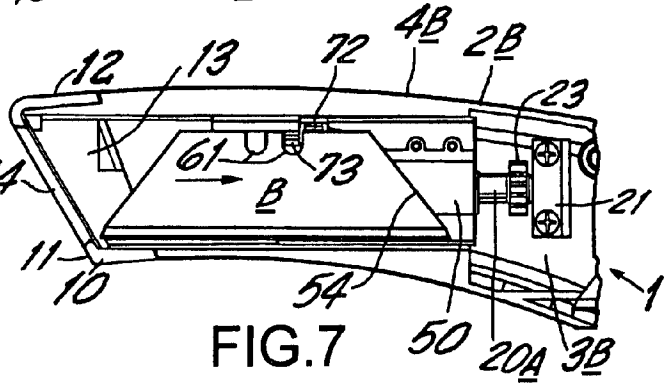
FIG. 7 is a sectional view taken along lines 7-7 of FIG. 5.
Figure 6:
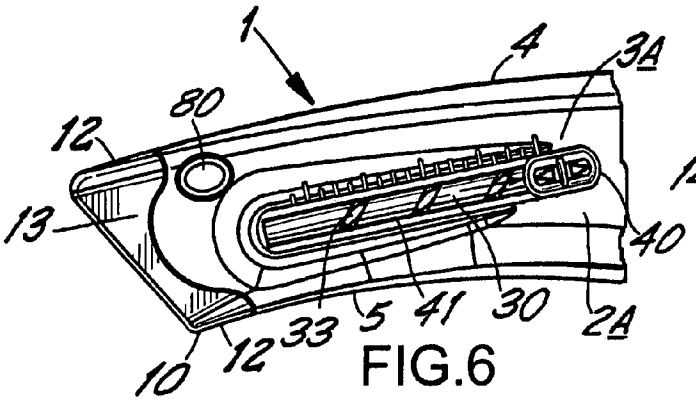
FIG. 6 is a fragmentary side view of the knife as shown in FIG. 5.
Figure 8:
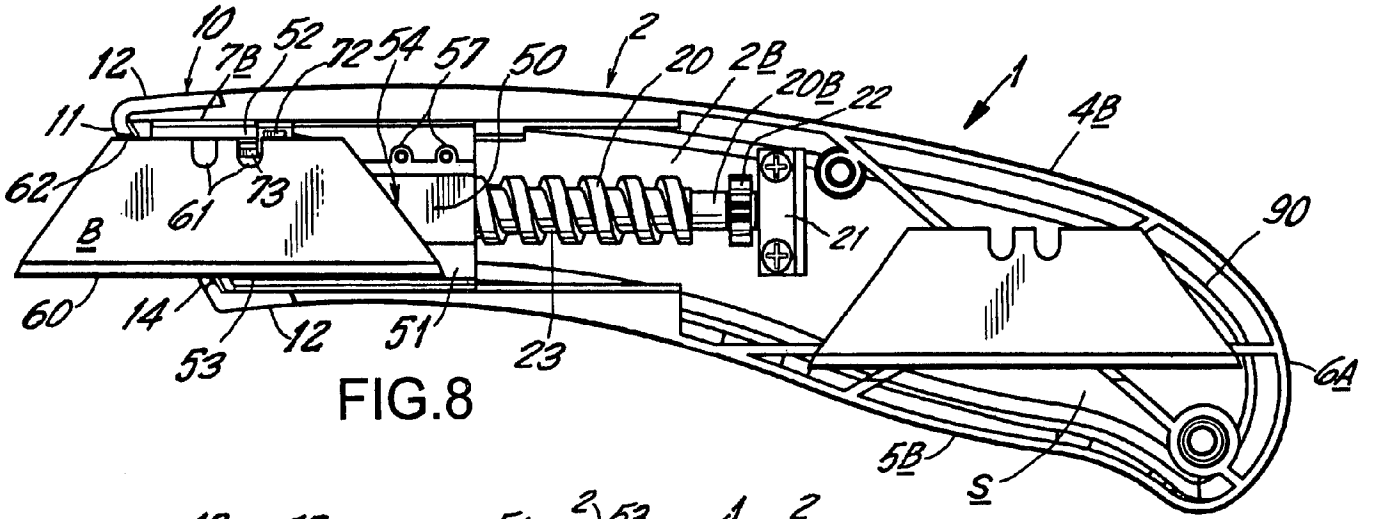
FIG. 8 is a sectional view taken along line 8-8 of FIG. 4.
Figure 9:
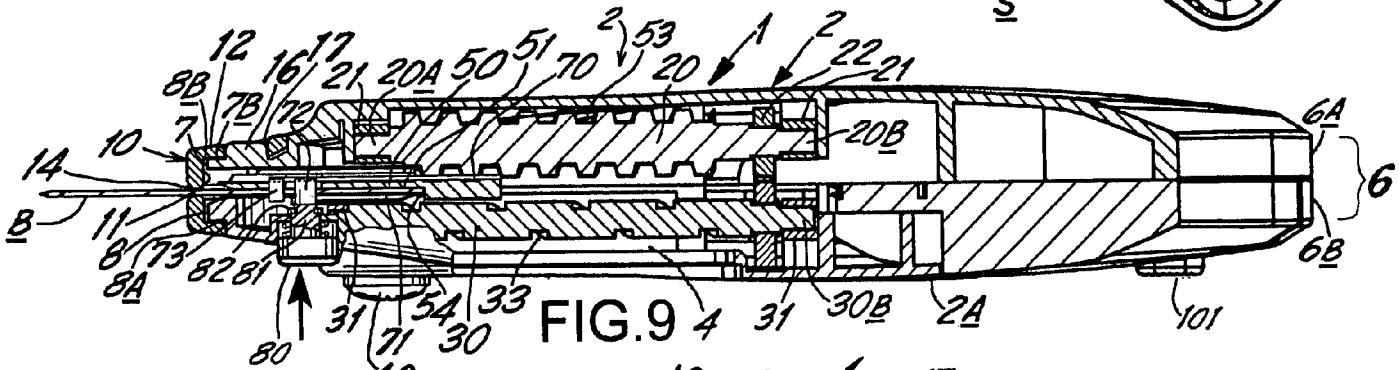
FIG. 9 is a sectional view similar to FIG. 4 showing the blade holding mechanism.
Figure 12:
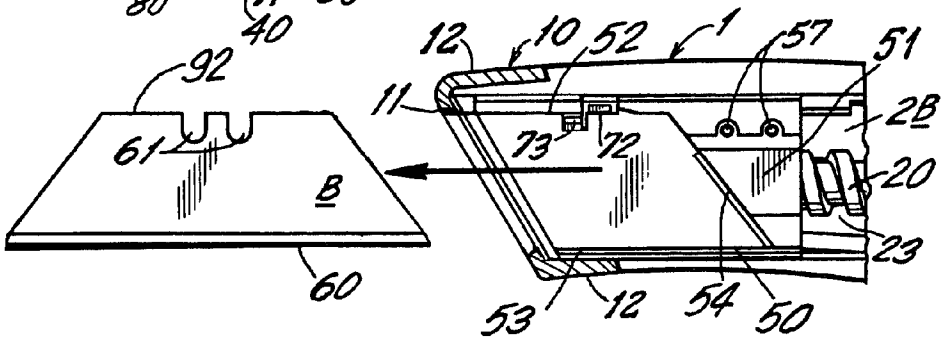
FIG. 12 is an enlarged fragmentary sectional view showing the removal of the blade.
Figure 10:
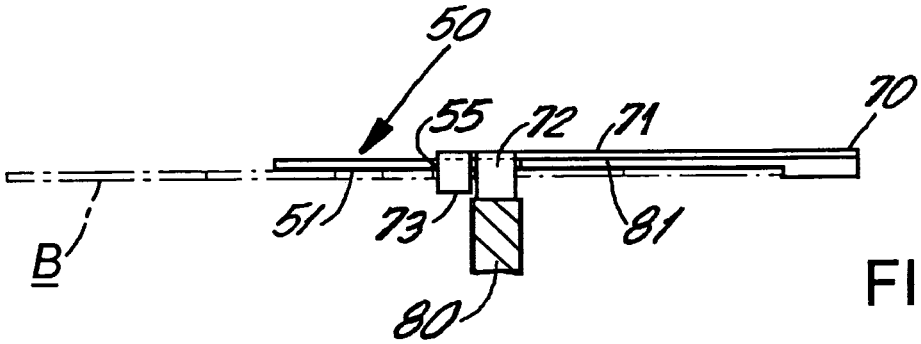
FIG. 10 is an enlarged detail of the blade holding mechanism in the blade locking position.
Figure 11:
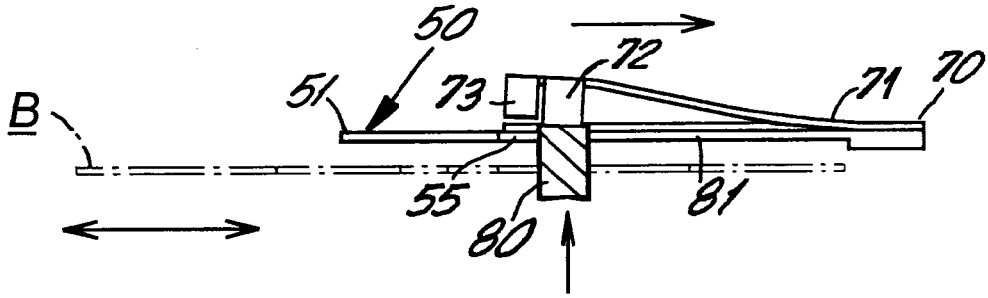
FIG. 11 is an enlarged detail similar to FIG. 10 showing the blade holding mechanism in its blade unlocking position.
Figure 13:
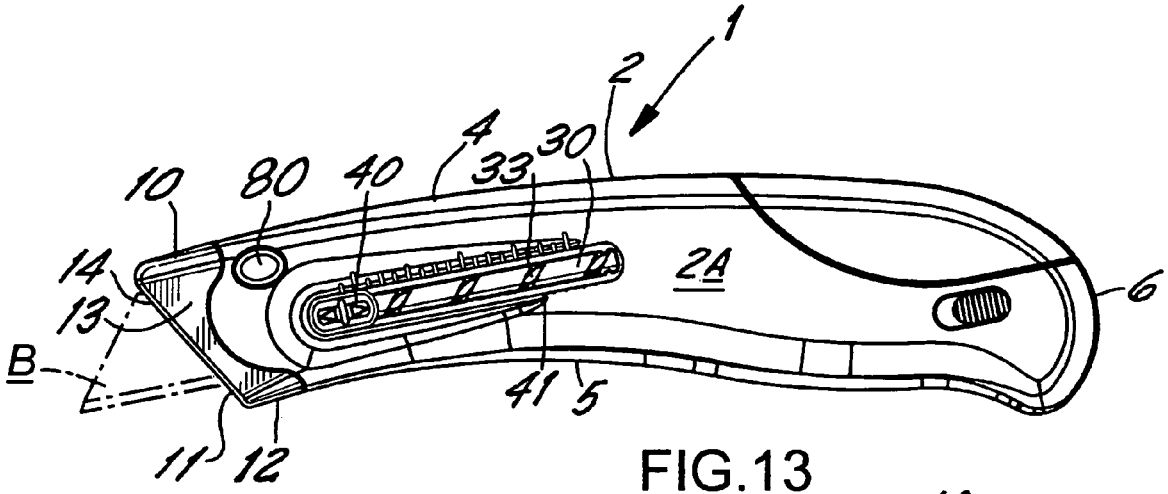
FIG. 13 is a side elevational view of knife of the present invention from one side.
Figure 14:
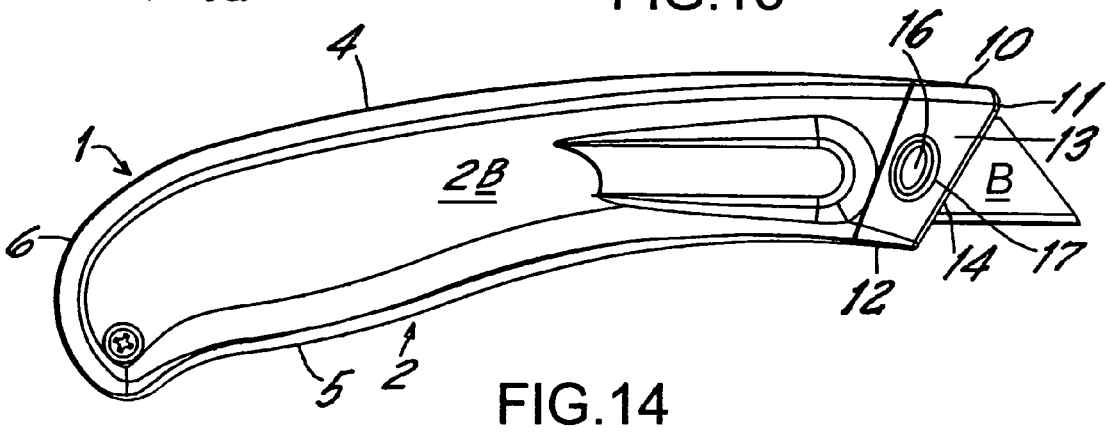
FIG. 14 is a side element view of the knife of the present invention from the other side.
Figure 15:
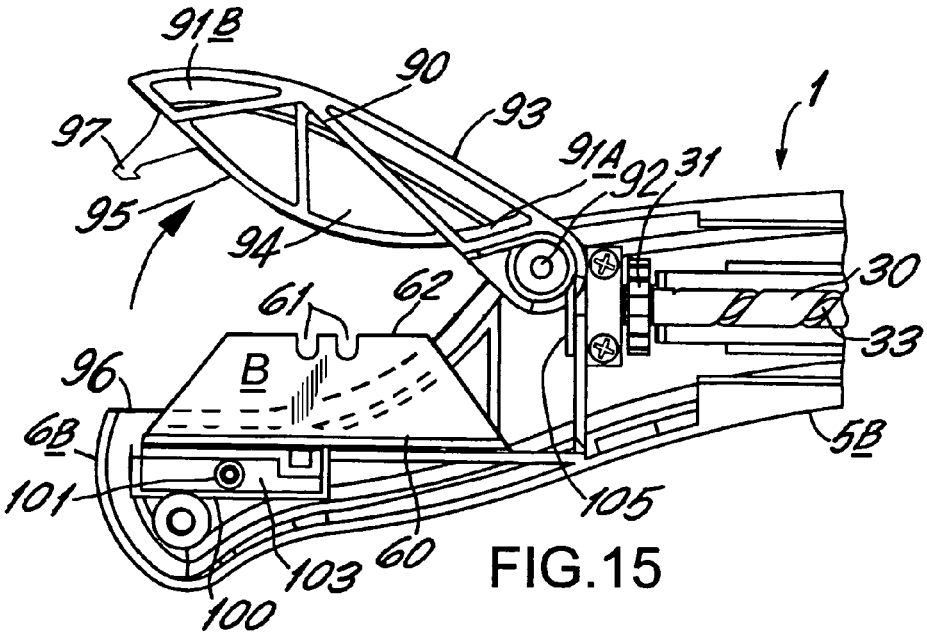
FIG. 15 is an enlarged fragmentary sectional view showing the blade storage compartment of the present invention.

Referring to the drawings, the utility knife 1 of the present invention comprising a first casing 2A half and a second casing half 2B which are assembled together to form the complete casing 2. Both casing halves 2A and 2B have respectively, a side wall 3A and 3B, a top wall 4A and 4B, a bottom wall 5A and 5B, a rear wall 6A and 6B and an open mouth 7A and 7B. The casing halves 2A and 2B are mounted together by any well known means, such as a fastener 17 to form top wall 4, bottom wall 5 and rear wall 6 and open mouth 7. The front ends of 8A and 8B of the two casing halves 2A and 2B are reduced so that when the casings 2A and 2B are mounted together a front end 8 of reduced dimension is formed. A mouth assembly 10 having a front wall 11 with a slit 14, an open bottom 15, end walls 12 and side walls 13 is mounted over the front ends 8A and 8B of the casing 2 together. A lock button 16 may be provided in the front end 8B adapted to be inserted into an opening 17 in a side wall 13 of the mouth assembly 10 in order to lock the mouth assembly 10 in place over the casing end 8. Thus, the two casings 2A and 2B are held together by the mouth assembly 10 held in place by the lock bottom 16 at the front and fastener means 18 at the rear of the casings 2A and 2B.

Mounted within the casing 2 are drive worm gear 30 and a driven worm gear 20. The worm gears 30 and 20 have front and rear ends 30A and 30B and 20A and 20B mounted in the joint 20 and 30. Each worm gear 20 and 30 has an interconnecting gear wheel 22 and 32 mounted on its rear ends 20A and 30A which are adapted to mesh with each other so that when the drive worm gear 30 rotates the driven worm gear 20 will also rotate. In the drawings the worm gears 20 and 30 are shown as being located within the casing 2 so that the drive worm gear 30 is located in casing half 2A and driven worm gear 20 is in the second casing half 2B thereby positioning the worm gears 20 and 30 in a side-by-side relationship. However, it will be understood that the positions of the worm gears 20 and 30 can be changed as long as the drive worm gear 30 and the driven worm gear 20 are mounted to permit their gear wheels 32 and 22 to mesh with each other. The drive worm gear 30 gear has a thread gauge 33 larger than the thread gauge 23 of the driven worm gear 20.

A finger slide button assembly 40 is slidably mounted in the side wall 3A through a slot 41 in said side wall 3A. The finger slide button assembly 40 has a finger 42 extending inwardly and meshing with the thread 33 of the drive worm gear 30. It is seen that when the finger slide button 40 is moved back and forth along the slot 4, the finger 42 slides in the thread 33 of the drive worm gear 30 to rotate the drive worm gear 30 in either direction. Since the drive wheel 32 at the rear of the drive worm gear 30 meshes with the drive wheel 22 at the rear of the driven worm gear 22, rotation of the drive worm gear 30 will rotate the driven worm gear 20.

A blade carrier assembly 50 is provided to receive a blade B. The blade B has a lower cutting edge 60 and notches 61 in its upper edge 62. The blade carrier assembly 50 comprises a flat body portion 51 having upper and lower walls 52 and 53 which are substantially parallel to each other and extend from the body portion 51 at a right angle thereto. A rear wall 54 is also provided. The body portion 51 is shown as being shaped substantially like a parallelogram, however it will be understood that the body portion 51 may be shaped differently, such as rectangular, etc. The upper wall 52 of the blade carrier assembly 51 has a notch 55 therein. The blade carrier assembly 50 also has fingers 56 extending thereafter which enter and mesh with the thread 23 of the driven worm gear 20 so that when that worm gear 30 is rotated, the blade carrier 50 will move along the thread 23 to the driven worm gear 20.

A resilient blade lock assembly 70 is mounted on one side (preferably the outside) of the blade carrier and is held there by fasteners 57. The blade lock assembly 70 comprises a resilient bar 71 having a release finger 72 and a blade holding finger 73 extending at right angles therefrom. The blade holding finger 72 extends through the notch 55 in the blade carrier 50 and into a notch 61 in the blade B. The release finger 72 is longer than the blade holding finger 73 and is at a higher level than the level of the blade holding finger 73 so that it extends over the top wall 52 of the blade carrier 50 for a distance greater than the blade holding finger 73. The support bar 71 in its unflexed position lies against the outside of the blade carrier 50 with the blade holding finger 73 extending into a notch 61 in the blade B and the release finger 72 extending over the top wall 54 of the blade carrier 50. In this manner the blade B is held in place on the blade carrier 50.

It will thus be seen that when the finger slide button assembly 40 is moved back and forth along slot 41, the drive worm gear 30 is rotated back and forth. This in turn rotates the driven worm gear 20 which allows the blade carrier 50 to move back and forth thereby extending or retracting the blade B to its full extent or only partially between a fully extended position and a fully retracted position. This movement of the blade B is variable depending on the forward and backward movement of the finger slide button assembly 40.

A spring pressed blade ejection button assembly 80 is mounted at the front of the casing and is biased outwardly by a spring 82 and is provided with an inner edge 81. The spring pressed button assembly 80 is at the same level as the blade release finger 72 extending from the resilient release bar 70. When it is desired to remove or replace the blade B, the blade B is placed in its most forward position so that it protrudes fully from the slit 11 in mouth 10. At this point, the inner edge 81 of the ejection button 80 is adjacent the blade release finger 72. When the blade ejection button 80 is pressed inwardly against the bias of the spring 82, its inner edge 81 strikes the release finger 72 and moves it inwardly. This flexes the resilient support bar 70 inwardly away from the body 50 to move the blade holding finger 73 inwardly out of the upper notch 61 in the blade B. This releases the blade B and the blade B can then be removed manually through the slit 11 in the mouth.

Replacement of the blade B may be accomplished in the same manner by pushing the ejection button 80 inwardly to move the release finger 72 and the blade holding finger 73 inwardly. The blade B is then slid into the blade carrier 50 through the slit 14 in the mouth 10. When the ejection button is released the bar 70 springs back to its original position and the blade holding finger 73 moves into the notch 61 of the blade B to hold it in place.

A blade storage compartment S also is provided at the rear of the casing half 2A to accommodate a plurality of spare blades B. The side wall 3A of the casing 2A has an opening top 90 in its side wall 3A which is adapted to be closed by a cover assembly 91. A front portion 91A of the cover assembly 91 is pivotally mounted to the wall of the casing half 2A my means of a pivot assembly 92. The cover assembly 91 has a top surface 93 with a side skirt 94 depending from the top surface 93. The side skirt 94 has a lower curved convex edge 95 which conforms to and mates with the concave edge 96 in the open top 90 of the side wall 3A when the cover assembly 91 is in its closed position.

The rear portion 91B of the cover assembly 91 also has a hook 97 extending downwardly therefrom. A latch assembly 100 is provided on side wall 3A with a finger button 101 extending through an opening 102 in the sidewall 3A. A lock bar 103 is spring pressed in an inward position so that it is normally positioned over the hook 97 to keep the cover assembly 90 in its closed position. When the lock bar 103 is moved by the finger button against a spring (not shown) in a forward direction it is moved from beneath the hook 97 to release the cover assembly 90 and to permit it to open. If desired, a spring mechanism 105 may be applied to the cover assembly so that it causes the cover assembly 90 to spring up under the influence of the spring 105 when the lock bar 102 is released from under the hook 97. In order to close the blade storage compartment S, the cover 90 is moved down against the bias to the spring 105 until the hook 97 snaps under the lock bar 102 to hold the cover assembly 90 of the blade storage compartment S in a closed position. A plurality of blades B may be stored within the blade storage compartment S, each of which can be removed when it is desired to replace an old blade with a new blade B.

In operation, a blade B is located on the blade carrier 50 which has fingers 56 meshing with thread 23 of the driven worm gear 20. The slide finger 40 is positioned in the slot 41 of the side wall 3A and has its finger 43 meshing with the thread 33 of the driving worm gear 30. When the slide finger 40 is moved forward or backward the driving worm gear 30 is rotated to rotate the driven worm gear 33 through the intermediation of the toothed gear wheel 32 and 22 at the rear of each worm gear 30 and 20, respectively. The rotation of the driven worm gear 20 causes the blade carrier 50 to move along the threads 23 of the driven worm gear 20. It will thus be seen the slide finger 40 may move the blade B all the way forward or all the way back or anywhere in between so that the amount of exposure of the blade B out of the slit 11 may be varied.

When it is desired to remove and replace a blade B the ejection button 80 is pushed inwardly. This moves the ejection finger 72 of the resilient bar 70 inwardly away from the blade carrier 50 which in turn moves the blade holding finger 73 out of the notch 61 in the blade B thereby permitting the blade B to be slid out of the slit 11 in the front face 14 and a new blade B to be slid into the front of slot 14.

It will thus be seen that the present invention provides and improved utility knife in which the blade holder may be easily moved into the handle, in which the blade is held securely on the blade holder, in which the blade moves easily to any position in which the blade may be moved variably in and out of the handle.

As many and varied modifications of the subject matter of this invention will become apparent to those skilled in the art from the detailed description given hereinabove, it will be understood that the present invention is limited only as provided in the claims appended hereto.

The embodiments of the invention in which an exclusive property or privilege is claimed are defined as follows:

1. A utility knife comprising a casing, a blade holder moveably mounted within the casing, means for moving said blade holder from a fully extended position outside the casing to a fully retracted position inside the casing, means for incrementally moving the blade holder between said fully extended and fully retracted position, said moving means comprises a gear mechanism operatively associated with the blade holder, said gear mechanism comprises a driven worm gear, a rotating mechanism operatively associated with the driven worm gear to rotate said driven worm gear to move said blade holder, said rotating mechanism comprises a drive worm gear operatively associated with said driven worm gear, a first interconnecting mechanism associated with said drive worm gear, a second interconnecting mechanism associated with said driven worm gear, said first and second interconnecting mechanisms being operatively associated with each other whereby rotation of the drive worm gear will rotate the driven worm gear, an activating mechanism moveably mounted on said casing, said activating mechanism being operatively associated with said drive worm gear whereby movement of said activating mechanism will rotate said drive worm gear, said activating mechanism comprises a slide button adapted to slide along the casing, said slide button being operatively associated with said drive worm gear whereby sliding the button along the casing will rotate said drive worm gear, said blade holder being operatively associated with said driven worm gear whereby rotation of said driven worm gear moves the blade holder along said casing, said first and second interconnecting mechanisms being gear wheels, said slide button having an engaging mechanism adapted to engage with the thread of said drive worm gear whereby movement of said slide button will rotate said drive worm gear, said blade holder being engaged with the driven worm gear whereby rotation of said drive worm gear will move said blade holder along said casing.

2. A utility knife as set forth in claim 1 wherein the drive worm gear and the driven worm gear each have a thread gauge and when the thread gauge of said drive worm gear is larger than the thread gauge of said driven work gear.

3. A utility knife as set in claim 2, wherein said drive and driven worm gears are mounted in journals mounted within said casing.

4. A utility knife as set forth in claim 1, wherein said blade holder comprises a moveable blade holding finger moveable into and out of engagement with a blade to hold said blade on the blade holder.

5. A utility knife as set forth in claim 4, wherein the blade holder also comprises a release finger adapted to move said blade holding finger out of engagement with said blade to permit said blade to be removed.

6. A utility knife as set forth in claim 5, wherein said blade holder comprises a moveable lock bar from which both the blade holding and the release fingers extend.

7. A utility knife as set forth in claim 6, wherein the release finger is longer than the blade holding finger.

8. A utility knife as set forth in claim 7, wherein a moveable release button is provided adjacent said release finger whereby movement of the release button move said release finger and said lock bar away from said blade holder to move the blade holding finger out of engagement with said blade.

9. A utility knife as set forth in claim 1, wherein a blade storage compartment is mounted in said casing.

* * * * *

UNITED STATES PATENT AND TRADEMARK OFFICE

CERTIFICATE OF CORRECTION

PATENT NO. : 7,621,051 B2
APPLICATION NO. : 11/523857
DATED : November 24, 2009
INVENTOR(S) : Qiu Jian Ping It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 442 days.

Signed and Sealed this

Twenty-sixth Day of October, 2010

David J. Kappos

David J. Kappos
*Director of the United States Patent and Trademark Office*